United States Patent [19]

Iwata

[11] 4,104,561

[45] Aug. 1, 1978

[54] MAGNETRON OPERATING CIRCUIT

[75] Inventor: Kozo Iwata, Kyoto, Japan

[73] Assignee: New Nippon Electric Co., Ltd., Osaka, Japan

[21] Appl. No.: 743,649

[22] Filed: Nov. 22, 1976

[30] Foreign Application Priority Data

Nov. 28, 1975 [JP] Japan ..... 50/162523[U]

[51] Int. Cl.[2] ..... H05B 39/00; H05B 41/14

[52] U.S. Cl. ..... 315/101; 219/10.55 B; 219/10.55 D; 315/39.51; 315/105; 315/85; 333/79

[58] Field of Search ..... 315/94, 101, 102, 85, 315/39.51, 97, 105; 328/230; 333/79; 219/10.55 B, 10.55 D

[56] References Cited

U.S. PATENT DOCUMENTS

| | | | |
|---|---|---|---|
| 3,651,371 | 9/1970 | Tingley | 315/102 |
| 3,681,652 | 8/1972 | Domenichini et al. | 315/85 |
| 3,789,263 | 1/1974 | Fritz et al. | 315/85 |
| 3,846,667 | 11/1974 | Hisada et al. | 315/39.51 |
| 3,924,196 | 12/1975 | Takahashi et al. | 315/39.51 |

*Primary Examiner*—Saxfield Chatmon, Jr.
*Attorney, Agent, or Firm*—W. G. Fasse; W. W. Roberts

[57] ABSTRACT

In the present magnetron operating circuit for generating microwave energy, the circuit components of the filter, the transformer and the rectifier are arranged within a shielded housing, in the same manner as the cathode input portion of a magnetron tube. A feed-through capacitor of the filter is arranged in the low voltage line of the transformer and secured to the wall of the housing to prevent undesired radiation. A coil with a ferrite core of the filter is preferably connected to the filament lead of the magnetron tube.

5 Claims, 3 Drawing Figures

MAGNETRON OPERATING CIRCUIT

BACKGROUND OF THE INVENTION

The invention relates to a magnetron operating circuit, and more particularly to a microwave energy generator which produces the desired microwave frequency output to be applied, for example, to a microwave oven, without the undesired radiation of spurious frequencies.

Generally, the source of electromagnetic energy in any microwave apparatus, such as a domestic cooking oven, is a magnetron type device, and a conventional operating circuit for the magnetron tube uses a high voltage transformer of the leakage type to provide a constant current to the magnetron, whereby the secondary winding has a rectifier to apply high voltages to the magnetron tube. In the normal operation, the magnetron tube generates microwave energy in a predetermined frequency range, but also other electromagnetic energy in a range of spurious frequencies. The output of such spurious frequencies is radiated and transmitted from the circuit components, lead wires and other structural elements of the device. This is not desired since it may jam wireless communications.

In other words, the output of the electromagnetic energy includes a major component in the fundamental frequency and a minor component in the spurious frequencies, whereby the spurious waves are in a wide frequency range covering kHz to GHz. These spurious frequencies or waves are radiated by the circuit components in the input structure of the magnetron type device. The main or fundamental wave, however, is utilized for the energization of the microwave apparatus. For this purpose the fundamental wave is transmitted by coupling means from the output portion of the magnetron device to the microwave application apparatus.

Further, the fundamental microwaves may also be radiated from the input part of the magnetron device in the form of leakage, whereby damage in a biological sense may be caused, due to its thermal effect, depending on the strength of the microwave energy. On the other hand, the spurious electromagnetic waves have an intensity level which is low relative to that of the fundamental waves, but still can jam electromagnetic communications. Therefore, these undesirable electromagnetic waves radiated into environment must be prevented or suppressed to a level below a permissible level. Hence, it is necessary to eliminate the electromagnetic waves from the input structure of the magnetron device. The electromagnetic waves from the input structure of the magnetron device are radiated directly to the free space or radiated to the environment during the transmission along the filament leads of the magnetron tube.

The conventional method for suppressing these undesired radiations provides a metal shield means for the individual circuits and uses a filter box having feed-through capacitors and ferrite core coils connected directly to the filament leads as the input structure of the magnetron tube.

In the prior art arrangement the radiation along the filament leads is absorbed by the ferrite core coils and attenuated by the feed-through capacitors, and the radiation from shielding means may be contained but for the feed-through capacitors because the attenuation characteristic of these feed-through capacitors is frequency dependent. Generally, the filter characteristic of this arrangement is not satisfactory, especially at the lower frequency band depending upon the capacitance of the feed-through capacitors. Furthermore, the feed-through capacitor has to withstand a high voltage because it is connected between the high voltage side of the transformer and ground. The power supply normally includes a half-wave rectifier in the voltage doubling circuit and a high voltage transformer of the leakage type, whereby the series circuit of the capacitor and the diode of the rectifier are connected to the secondary winding of the high voltage transformer. Also, to improve the attenuation characteristic at the lower frequency band in such an arrangement, it is necessary to increase the capacitance of the feed-through capacitor which must be of the high-voltage type. However, it is expensive to increase the capacitance of high voltage type capacitors to obtain a satisfactory attenuation characteristic.

SUMMARY OF THE INVENTION

It is an object of this invention to provide a magnetron operating circuit having a low-voltage type feed-through capacitor at the primary winding of the high voltage transformer.

Another object of this invention is to provide a metal shield housing which encircles all operating circuit components such as the choke coil, the high voltage transformer, capacitor, diode, and the input part of a microwave generator, such as the magnetron tube, excepting the output structure of the magnetron tube. The feed-through capacitors, having a relatively large capacitance, are secured to the metal shield housing and connected to the primary winding of the high voltage transformer. In this arrangement, the electromagnetic waves from the input part of the magnetron tube are absorbed or attenuated in the same manner as mentioned in the prior art, but the effect of the filter characteristic is significantly improved at a relatively low frequency band without sacrificing the other desired characteristics. Also important, the costs for a low voltage feed-through capacitor are substantially lower. The choke coil is preferably connected in series with the filament lead in the input part of the microwave generator so as to absorb as much energy as possible before the radiation can get into the metal shield housing.

According to the invention, the choke coil is arranged at the high voltage end of the power supply circuit as mentioned above. However, the feed-through capacitor is arranged at the primary side of the power supply circuit. Further, the shielding means contain circuit components for preventing undesired radiation. A single shielding housing is used as the shielding means, which is preferably provided with a partition to form separate compartments, one of which is for the choke coils. The shielding is more effective if only the choke coil is inserted in its own shielding compartment at the input side of the magnetron tube. The invention further uses separate metal housings interconnected by a shielded cable so that one housing or casing is for the choke coils and the input part of the magnetron tube and the other casing is for the other components.

The advantage of this invention is seen in that the filter characteristic at the lower frequency band is improved by changing the position of the feed-through capacitors from the high voltage side to the low voltage side. At the same time substantial savings are achieved by reducing the break-down voltage of the feed-through capacitor. Another advantage of this invention is seen in that the overall costs are reduced since there is no need for precautions against the radiation from the input power supply.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS

Figure 1:
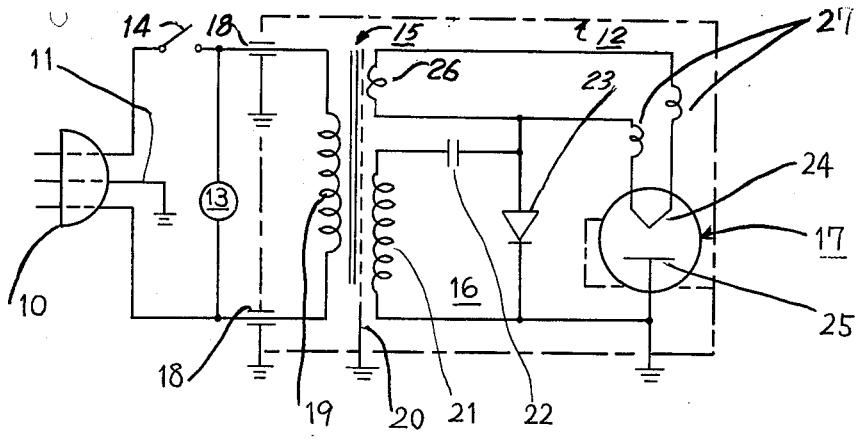
FIG. 1 is a basic circuit diagram of an embodiment of this invention.

FIG. 1 shows a schematic circuit diagram of a microwave generator embodying the present invention as used in a cooking oven. A conventional connector 10 having a grounded lead 11 connects the magnetron operating circuit 12 of this invention and the auxiliary electrical devices of the oven, such as a stirrer motor 13, to the commercial line voltage of the a.c. power source through a switch 14. All electrical components of the circuit 12 are enclosed by shielding means as described hereinafter. The circuit 12 comprises a high voltage transformer 15, a doubler voltage rectifier 16, a magnetron tube 17 and feed-through capacitors 18 as filter means. Upon closure of the switch 12, the line voltage is applied across the primary winding 19 of the transformer which is grounded at 20. The secondary winding 21 of the transformer is connected, through a half-wave rectifier 16 of the doubler voltage type having a capacitor 22 and a diode 23, to the cathode 24 of the magnetron tube 17 which includes a grounded anode 25. To provide the operating voltage for appropriate fields between the cathode and anode, the line voltage is stepped up by the high voltage transformer 15 to voltages in the range from 3 to 6 kilovolts.

Figure 2:
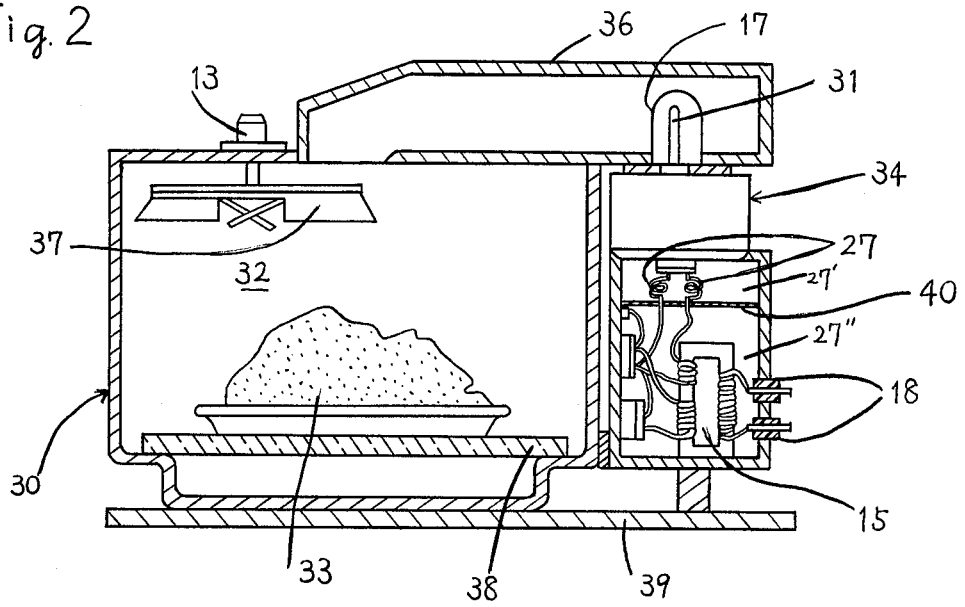
FIG. 2 is an illustration of a microwave oven constructed according to the invention.

The microwave oscillations generated at the magnetron tube 17 are coupled to the cooking oven 30 through a coupling antenna 31 and fed into the cooking chamber 32 as shown in FIG. 2.

The magnetron cathode 24, commonly of the thoriated tungsten directly-heated type, acts as a filament. Electrical current for the filament cathode 24 is provided by heating windings 26 connected through lead wires. To absorb any leakage output from such lead wires, choke coils 27, each of which is provided with a ferrite core, are directly connected to the filament cathode 24.

In the prior art, the output of spurious frequencies and leakage of the fundamental frequency generated by the magnetron tube 17 may be transmitted through the filament leads or stray capacitances to input parts of the circuit arrangement. Therefore, they may be radiated as jamming or undesired radiation.

For suppression of the above defects, the choke coil 27 absorbs such leaked or undesired output from the filament wire, and the feed-through capacitor 18 serves to attenuate undesired radiation. According to the present invention, the feed-through capacitor 18 is connected to the low voltage line of the transformer 15, whereby the necessary break-down voltage of the capacitor 18 is substantially reduced.

FIG. 2 shows the cooking oven 30 of an embodiment of the present invention, wherein the cooking chamber 32 serves as the oven for cooking articles of food 33. A microwave generator 34 which comprises the magnetron tube 17, permanent magnet and other elements not shown, is coupled to the shielding housing 35 which contains all electrical elements of the transformer 15, rectifier 16 and filter means for the magnetron operating circuit 12. It is preferred to form separate compartments by using a shielding partition 40 within the shielding housing 35, because the undesired radiation from the input part of the microwave generator 34 is suppressed by the partition 40. The electromagnetic energy from the generator 34 is coupled by means of antenna 31 within the magnetron tube 17, to a wave guide section 36 adapted to propagate the energy of the desired frequency into the oven chamber 32. Upon energizing of the microwave generator 34, the electromagnetic waves radiated within the oven chamber are uniformly distributed by stirrer 37 driven by the motor 13. The food is disposed on a dielectric plate 38 and the common supporting base 39 of conductive material is used for complete grounding of the microwave oven 30 and the shield housing 35.

In the above structure, some amount of the electromagnetic energy is radiated within the housing 35 around the cathode side of the microwave generator 34 before reaching the ferrite core choke coils 27. Some energy is also radiated from the transmission path along the circuit lead wires and other elements after passing through the choke coils 27, or the energy is transmitted directly to the power supply side through the high voltage transformer 15. However, the housing 35 which is filled with such undesired radiation prevents or suppresses the radiation and its transmission outside of the housing. While spurious frequency components may be picked up by the connecting lead wires of the operating circuit 12 again to be repeatedly transmitted and radiated, the primary low voltage line of the high voltage transformer 15 is inevitably excited by these spurious frequency components which will pass through the shield housing 35 along the lead wires of the a.c. power source unless one or more feed-through capacitors 18 is provided. When the capacitance of this feed-through capacitor 18 is selected at a proper, relatively large value, the spurious components which are passing through the capacitors 18 will be attenuated efficiently and hence, the lead wires outside the shielding housing 35 will not be excited, and no radiation takes place.

By use of the partition 40, the shielding characteristic is much improved because of the shielding effect thereof. The shielding means include a first shielding case 27' or compartment for the choke coils 27, a second shielding case 27'' for the other elements. A shielded cable is provided for coupling these two shielding cases 27'' so as to improve the shielding effect.

In the actual circuit of FIG. 1, the capacitance of the feed-through capacitors is preferably chosen within a range of 1000 to 2000pF. Contrary thereto, conventional feed-through capacitors which have been employed at the secondary high voltage line of the operating circuit, have a capacitance about 500pF. For suppressing the FM, TV band interference. The capacitance of 1000 to 2000pF is sufficient to suppress the low radio frequency band interference without sacrificing the the desired characteristic at the higher frequency band. It is important that the price of the feed-through capacitor, is much lower by using a low break-down voltage type. Thus, the price for the low voltage capacitors used according to the invention is about one tenth of the conventional high voltage type capacitors.

Figure 3:
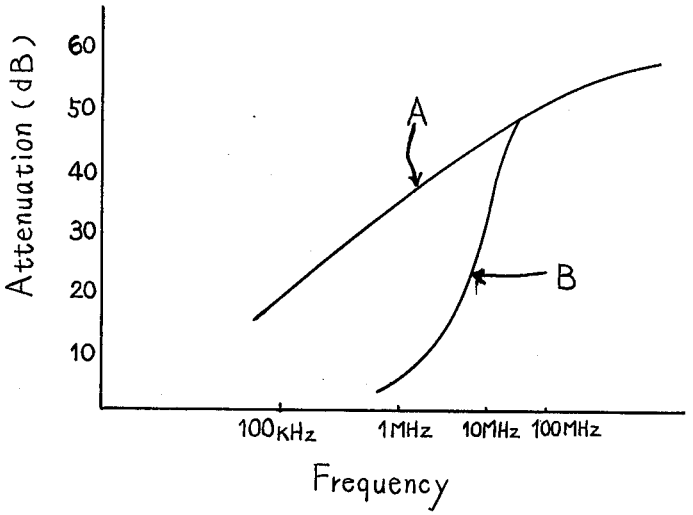
FIG. 3 is a graph showing the effect of the filter characteristics comparing with the conventional filter.

FIG. 3 shows the attenuation characteristic of the feed-through capacitor of the present invention comparing it with the conventional filter box capacitor, wherein the curve "A" of a 2000pF capacitor of this invention has a high level attenuation characteristic in comparison with the conventional 500pF capacitor. According to this invention, since the outer cabinet case of the oven may be made of plastics materials which is conventionally coated with a metal to form a shielding for the radiation from the power supply circuit, the cost of the entire device can be substantially reduced, especially in combination with the use of the inexpensive feed-through capacitor which also improves the performance of the device at the same time.

Although the invention has been described with reference to specific example embodiments, it is to be understood that it is intended to cover all modifications and equivalents within the scope of the appended claims.

What is claimed is:

1. An operating circuit for energizing a magnetron tube from an a.c. low voltage power source comprising a microwave generator including a magnetron tube having an anode and a cathode, a high voltage transformer having a primary winding and conductor wires connecting said primary winding to said a.c. power source and a secondary winding connected to said magnetron, a rectifier coupled to said magnetron tube and poled oppositely to said magnetron so as to allow the flow of current through the magnetron tube for alternate half-cycles of said a.c. power source, a filter including a pair of feed-through capacitors and a choke coil, and means for shielding said high voltage transformer, said rectifier and said filter by a metal shield housing to suppress undesired radiation, one of said feed-through capacitors of said filter being operatively connected to each of said conductor wires which connect said primary transformer winding to said low voltage power source, each of said feed-through capacitors having a relatively large capacitance, for example, at least about 1000pF.

2. The operating circuit of claim 1, wherein said choke coil of said filter includes a ferrite core, said choke coil being inserted in the path of electromagnetic oscillation near the input part of said microwave generator.

3. The operating circuit of claim 2, wherein said shielding means comprises a single metal housing and a shielding partition within said metal housing so as to form separate compartments, one of which is for said ferrite core choke coil.

4. The operating circuit of claim 2, wherein said shielding means comprises a first shielding casing for said choke coil, a second shielding casing for said transformer, said rectifier and said feed-through capacitor, and a shielding cable for coupling said first and second shielding casings to each other.

5. The operating circuit of claim 1, wherein said feed-through capacitors are mounted to said shielding means.

* * * * *